US007784643B1

(12) United States Patent
Levine

(10) Patent No.: US 7,784,643 B1
(45) Date of Patent: Aug. 31, 2010

(54) VENDING MACHINE MESSAGING SYSTEM

(76) Inventor: David T. Levine, 4125 E. Nighthawk Way, Phoenix, AZ (US) 85048

( * ) Notice: Subject to any disclaimer, the term of this patent is extended or adjusted under 35 U.S.C. 154(b) by 0 days.

(21) Appl. No.: 11/957,282

(22) Filed: Dec. 14, 2007

Related U.S. Application Data

(60) Provisional application No. 60/875,028, filed on Dec. 16, 2006.

(51) Int. Cl.
*G07F 11/00* (2006.01)

(52) U.S. Cl. ..... 221/199; 221/8; 221/155; 700/241

(58) Field of Classification Search ..... 700/231–244; 221/1–312 C
See application file for complete search history.

(56) References Cited

U.S. PATENT DOCUMENTS

| | | | | |
|---|---|---|---|---|
| 5,831,862 | A * | 11/1998 | Hetrick et al. | 700/232 |
| 6,131,399 | A * | 10/2000 | Hall | 62/127 |
| 6,154,994 | A * | 12/2000 | O'Brien et al. | 40/575 |
| 6,155,455 | A * | 12/2000 | Yajima et al. | 221/97 |
| 6,367,653 | B1 * | 4/2002 | Ruskin et al. | 221/1 |
| 6,386,389 | B1 * | 5/2002 | Percy et al. | 221/155 |
| 6,412,654 | B1 * | 7/2002 | Cleeve | 221/7 |
| 6,808,268 | B2 * | 10/2004 | Vrachan et al. | 353/10 |
| 6,834,452 | B2 * | 12/2004 | Martin et al. | 40/544 |
| 7,038,398 | B1 * | 5/2006 | Lys et al. | 315/291 |
| 7,040,535 | B2 * | 5/2006 | Sato et al. | 235/381 |
| 7,161,494 | B2 * | 1/2007 | Akuzawa | 340/815.4 |
| 2005/0251287 | A1 * | 11/2005 | Thornton et al. | 700/233 |
| 2006/0247824 | A1 * | 11/2006 | Walker et al. | 700/241 |
| 2007/0026916 | A1 * | 2/2007 | Juds et al. | 463/1 |
| 2007/0225860 | A1 * | 9/2007 | Sheppard et al. | 700/236 |
| 2007/0241120 | A1 * | 10/2007 | Henry | 221/2 |
| 2008/0051933 | A1 * | 2/2008 | Vrachan et al. | 700/231 |
| 2009/0039101 | A1 * | 2/2009 | Alcov | 221/155 |

OTHER PUBLICATIONS

"MB Media Brokers Installs LED Sign in Glassfront Vender, Sees Potential to Boose Operator ROI Through Advertising", Vending Times magazine, Oct. 2007, p. 22.

Isochron Inc., home page, website <available at http://www.isochron.com/>.

Isochron Inc., "Vending Management", website <available at http://www.isochron.com/products/vending_management_overview.html>.

(Continued)

*Primary Examiner*—Gene Crawford
*Assistant Examiner*—Michael K Collins
(74) *Attorney, Agent, or Firm*—Neustel Law Offices

(57) ABSTRACT

A vending machine messaging system for displaying messages within a vending machine. The vending machine messaging system generally includes a vending machine having a window, a display unit attached to an interior surface of the window and a server in communication with the display unit via a communications network. The server communicates various messages to be displayed by the display unit such as advertisements, stock quotes, news, weather, nutritional content of the merchandise and the like. The vendor is able to add their own messages for display on their vending machines by communicating with the server. Advertisers add various advertisements to the server which are then reviewed and disseminated to the appropriate vending machines.

15 Claims, 6 Drawing Sheets

OTHER PUBLICATIONS

Automated Vending Technologies Inc., website <available at http://www.avtinconline.com/index.html> 2 pages.

Automated Vending Technologies Inc., "Optional Upgrades", website <available at http://www.avtinconline.com/technologies.html> 2 pages.

Automated Vending Technologies Inc., "AVTI Media", website <available at http://www.avtinconline.com/pixel_video2.htm> 2 pages.

Automated Vending Technologies Inc., "VMS-Vending Management Systems", website <available at http://www.avtinconline.com/vms_video.htm> 2 pages.

* cited by examiner

VENDING MACHINE MESSAGING SYSTEM

CROSS REFERENCE TO RELATED APPLICATIONS

I hereby claim benefit under Title 35, United States Code, Section 119(e) of U.S. provisional patent application Ser. No. 60/875,028 filed Dec. 16, 2006. The 60/875,028 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to vending machines and more specifically it relates to a vending machine messaging system for displaying messages within a vending machine.

2. Description of the Related Art

Any discussion of the related art throughout the specification should in no way be considered as an admission that such related art is widely known or forms part of common general knowledge in the field.

Conventional vending machines dispense various types of items to consumers such as but not limited to candy bars, bags of chips, packages of gum, personal care items, tobacco products and the like. While attempts have been made to place stationary advertisements on vending machines, it is difficult to maintain such advertisements up-to-date in a cost effective manner. In addition, static advertisements on vending machines a time consuming to implement and do not provide an effective means to catch the eyes of consumers.

Because of the inherent problems with the related art, there is a need for a new and improved vending machine messaging system for displaying messages within a vending machine.

BRIEF SUMMARY OF THE INVENTION

The general purpose of the present invention is to provide a vending machine messaging system that has many of the advantages of the vending machines mentioned heretofore. The invention generally relates to a vending machine which includes a vending machine having a window, a display unit attached to an interior surface of the window and a server in communication with the display unit via a communications network. The server communicates various messages to be displayed by the display unit such as advertisements, stock quotes, news, weather, nutritional content of the merchandise and the like. The vendor is able to add their own messages for display on their vending machines by communicating with the server. Advertisers add various advertisements to the server which are then reviewed and disseminated to the appropriate vending machines.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a vending machine messaging system for displaying messages within a vending machine.

Another object is to provide a vending machine messaging system that displays various types of messages including but not limited to advertisements, notices about the products in the vending machine, nutritional information about the products in the vending machine, stock quotes, news, current weather, weather warnings, real estate, apartments, tornado alerts, "Amber Alerts", safety messages, trivia questions and answers, and status of the vending machine.

An additional object is to provide a vending machine messaging system that immediately sends a message out through numerous vending machines.

A further object is to provide a vending machine messaging system that may send different messages to vending machines based upon various factors such as the geographic location, the owner and/or the type of vending machine.

Another object is to provide a vending machine messaging system that may communicate with the display units utilizing various communication systems including but not limited to a global computer network, wireless pager network, wireless network and the like.

Another object is to provide a vending machine messaging system that is capable of sending a sequence of messages to the display units within the vending machines.

Another object is to provide a vending machine messaging system that may be integrally formed within a vending machine or attached as an aftermarket device.

Another object is to provide a vending machine messaging system that is easily removed from one vending machine and installed in another.

Another object is to provide a vending machine messaging system that provides a vendor with the ability to add their own messages to their vending machines.

Another object is to provide a vending machine messaging system that does not interfere with the operation of the vending machine.

Another object is to provide a vending machine messaging system that may be connected to the remote machine monitoring system.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
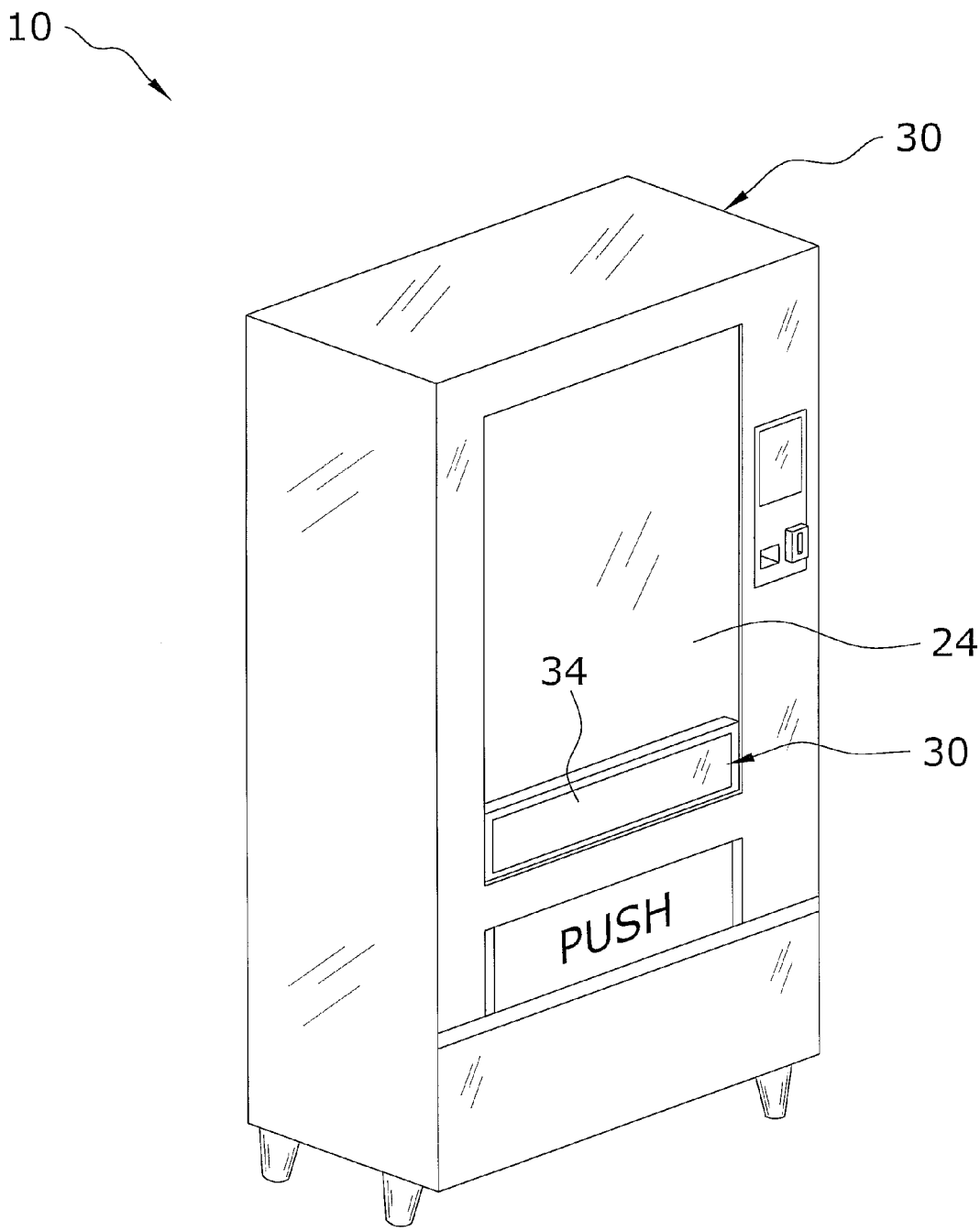
FIG. 1 is an upper perspective view of a preferred embodiment of the present invention.

Turning now descriptively to the drawings, in which similar reference characters denote similar elements throughout the several views, FIGS. 1 through 7 illustrate a vending machine messaging system 10, which comprises a vending machine 20 having a window 24, a display unit 30 attached to an interior surface of the window 24 and a server 19 in communication with the display unit 30 via a communications network 14. The server 19 communicates various messages to be displayed by the display unit 30 such as advertisements, stock quotes, news, weather, nutritional content of the merchandise 12 and the like. The vendor 16 is able to add their own messages for display on their vending machines 20 by communicating with the server 19. Advertisers 18 add various advertisements to the server 19 which are then reviewed and disseminated to the appropriate vending machines 20.

B. Vending Machine

Figure 2:
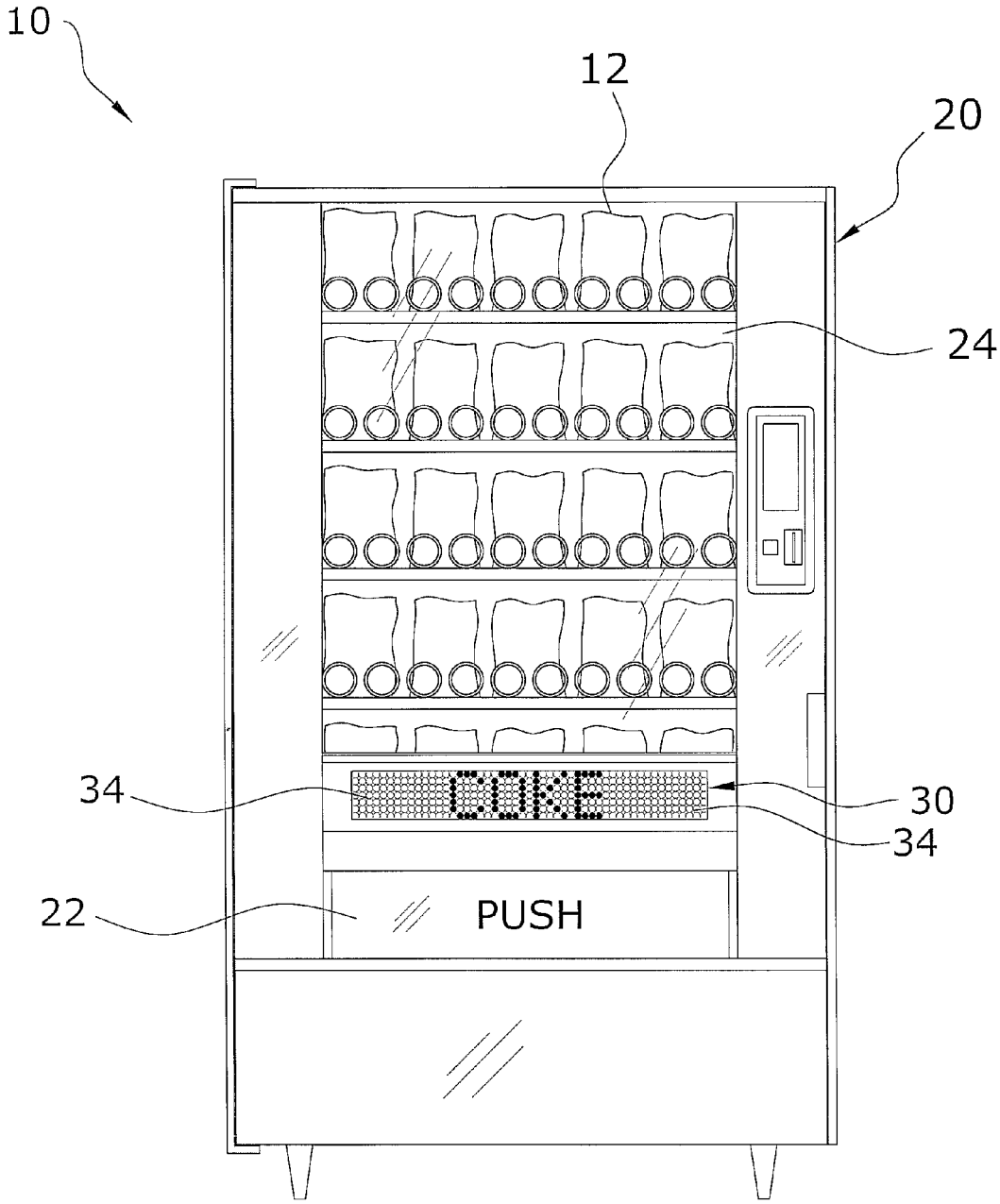
FIG. 2 is a front view of the preferred embodiment of the present invention.
Figure 3:
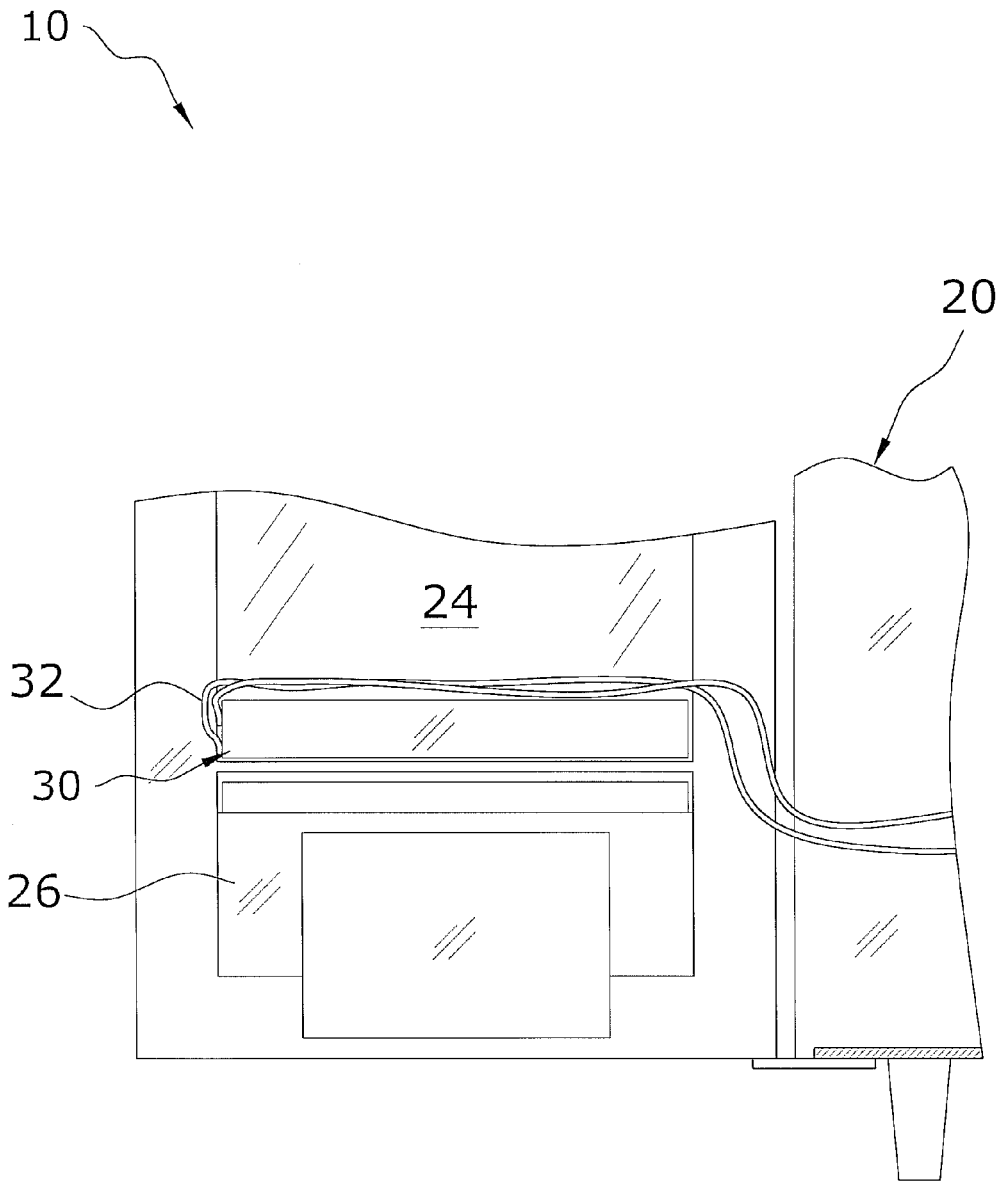
FIG. 3 is a rear view of the preferred embodiment.

FIGS. 1 and 2 illustrate an exemplary vending machine 20. A conventional vending machine 20 typically includes a window 24 within a front portion of the vending machine 20 to display the merchandise 12 within the vending machine 20. The window 24 may be positioned within a side portion of the vending machine 20 also. The window 24 is typically rectangular shaped but it may be comprised of various other shapes. The vending machine 20 is typically comprised of a rectangular box shaped structure, however various other shapes and structures may be used for the vending machine 20.

The merchandise 12 within conventional vending machines 20 include but are not limited to candy bars, bags of chips, packages of gum, personal care items, tobacco products and the like. The consumer inserts payment (e.g. cash, coins, credit card, etc.) into the vending machine 20, makes a selection of the merchandise 12 they would like purchased and the vending machine 20 dispenses the selected merchandise 12 into the hopper 26 which can be accessed through a movable door 22 in the vending machine 20. Some vending machines 20 are comprised of a game device (e.g. claw games) that allows a player to attempt to select a specific item within the interior of the vending machine 20 with a movable claw device.

The preferred embodiment of the present invention is designed to be added to existing vending machines 20 already in operation. However, the preferred embodiment of the present invention may also be attached to a new vending machine 20 during the manufacture of the vending machine 20.

C. Display Unit

FIGS. 1 through 6 of the drawings illustrate an exemplary display unit 30 preferably attached to an interior surface of the window 24 of the vending machine 20. The display unit 30 is preferably comprised of an LED dot-matrix display, however various other display technologies may be utilized for the display unit 30. The display unit 30 is preferably capable of displaying both text and graphics in various colors, however a single color display may be utilized. The front face 34 of the display unit 30 is preferably comprised of an elongated rectangular structure having a length substantially equal to the width of the window 24 of the vending machine 20 to maximize the message display area without interfering with the viewing of the merchandise 12.

While the display unit 30 may be attached externally of the vending machine 20 or to another surface within the interior of the vending machine 20, it is preferable to attach to the interior surface of the window 24 to provide maximum visibility for the front face 34 of the display unit 30. In particular, it is preferable to attach the display unit 30 to the lower portion 44 of the interior surface of the window 24 to not interfere with the viewing of the merchandise 12 within the vending machine 20.

The display unit 30 displays messages received from the server 19 via the communications network 14. The display unit 30 may also display messages that are preprogrammed or that are directly entered by a vendor 16 on site. The messages may be comprised of but not limited to advertisements, notices about the products in the vending machine 20, nutritional information about the products in the vending machine 20, information about the products in the vending machine 20 or a nearby vending machine 20, stock quotes, news, current weather, weather warnings, real estate, apartments, tornado alerts, "Amber Alerts", safety messages, trivia questions and answers, and status of the vending machine 20.

In addition, a coupon code, redemption offer or other type of code may be displayed in conjunction with a particular message along with a website address for a consumer to login into. When the consumer logs into the website to redeem their code, they provide the code to the website which then provides a coupon for the consumer to print out that may be used for a discount, a free item or other benefit for the consumer.

Figure 6:
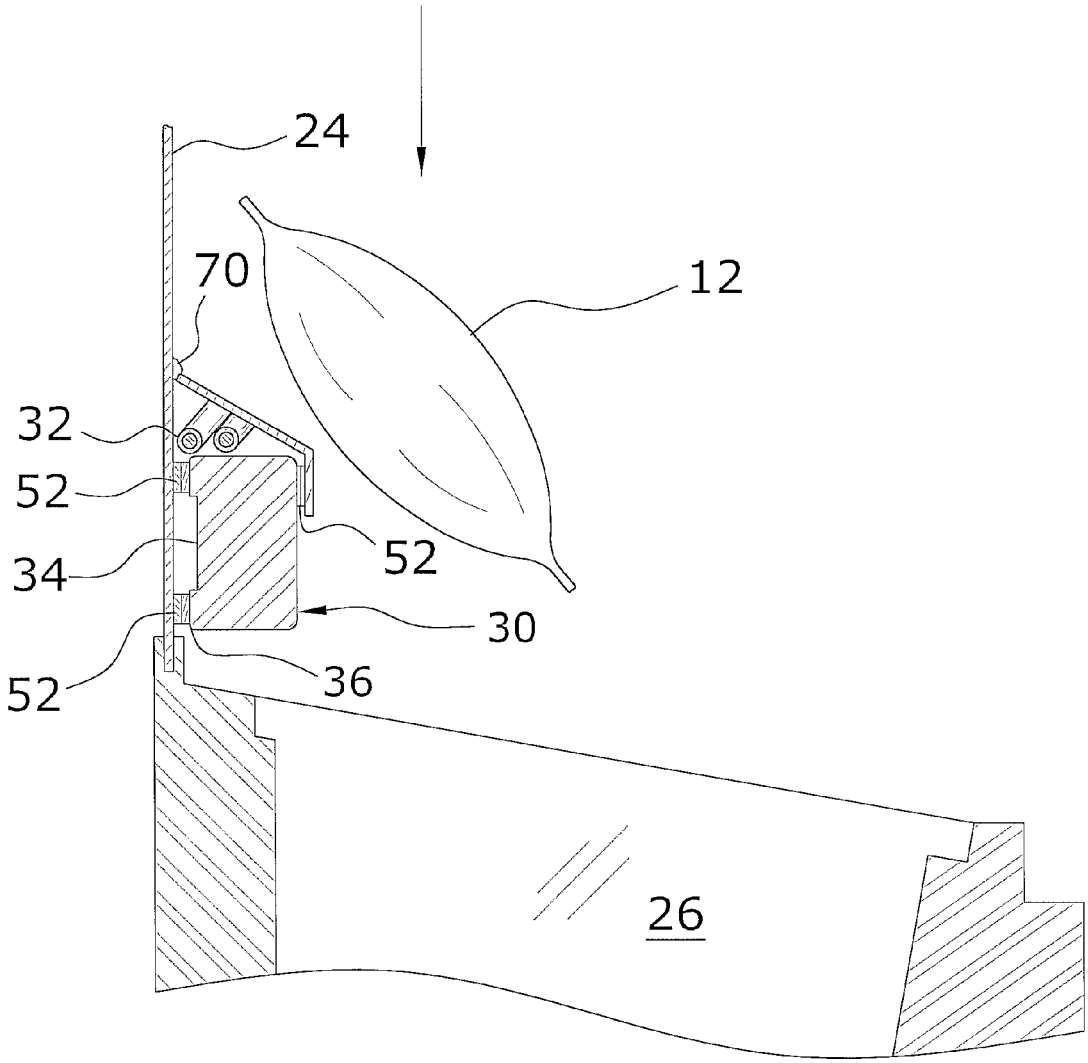
FIG. 6 is a cross sectional view taken along line 6-6 of FIG. 5.

The display unit 30 is attached to the interior surface of the window 24 by at least one front securing device 50. As shown in FIG. 6 of the drawings, a pair of upper and lower front securing devices 50 are attached between the interior surface of the window 24 of the vending machine 20 and the extended front portions 36 of the display unit 30. The front securing device 50 may be comprised of various types of fasteners such as but not limited to adhesive, adhesive strips, hook and loop faster, suction cups and the like. The front securing device 50 preferably is easily removed from the window 24 to prevent damage to the window 24 during removal thereof.

D. Shield

Figure 4:
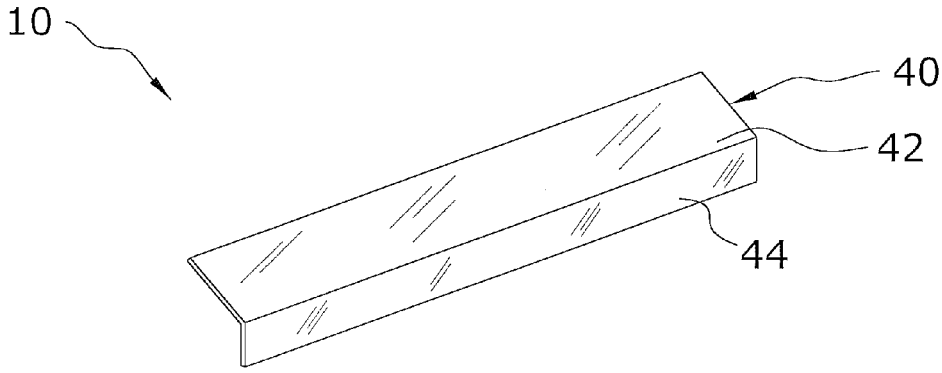
FIG. 4 is an upper perspective view of a shield.
Figure 5:
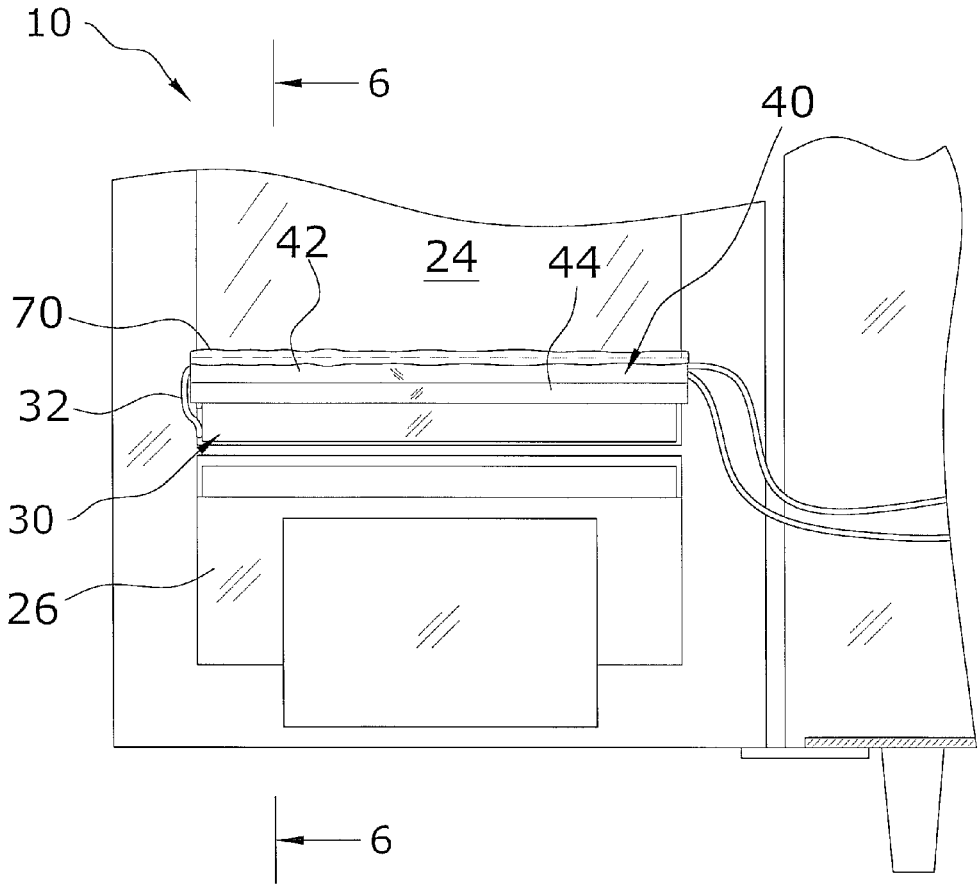
FIG. 5 is a rear view of the shield attached to the vending machine above the display unit.

FIGS. 4 through 6 illustrate a shield 40 attached to the interior surface of the window 24 to protect the display unit 30 and to prevent the merchandise 12 from becoming caught on the upper surface of the display unit 30. The shield 40 may be comprised of various types of materials including but not limited to metal and plastic.

The shield 40 is positioned above the display unit 30 as best illustrated in FIG. 6 of the drawings. The shield 40 preferably has a length approximately equal to the length of the display unit 30 as best illustrated in FIG. 5 of the drawings. The shield 40 may have a length longer than the display unit 30 to protect the sides and wiring 32 of the display unit 30.

As shown in FIGS. 4 and 6 of the drawings, the shield 40 is preferably comprised of an upper portion 42 extending downwardly at an angle from the interior surface of the window 24 and a lower portion 44 extending downwardly from the upper portion 42. The angle of the upper portion 42 may vary, but is preferably sufficient to allow merchandise 12 dispensed from various levels within the vending machine 20 to engage and slide off into the hopper 26. The upper edge of the upper portion 42 may be attached to the window 24 utilizing various fastener technologies. The shield 40 preferably defines a passage between the window 24 and the shield 40 wherein a length of wiring 32 connected to the display unit 30 passes through the passage for protection as shown in FIG. 6 of the drawings.

It is preferable to have a length of sealant 70 (e.g. transparent caulking) attached to the interior surface of the window 24 and the upper portion 42 of the shield 40 to prevent cleaning solutions used on the interior surface from passing between the display unit 30 and the window 24. The length of sealant 70 preferably extends along the entire length of the upper edge of the upper portion 42.

As best illustrated in FIG. 6 of the drawings, the lower portion 44 of the shield 40 is preferably attached to a rear face of the display unit 30 by a rear securing device 52. The rear securing device 52 may be comprised of various types of fasteners such as but not limited to adhesive, adhesive strips, hook and loop faster, magnets and the like.

E. Communication Unit

Figure 7:
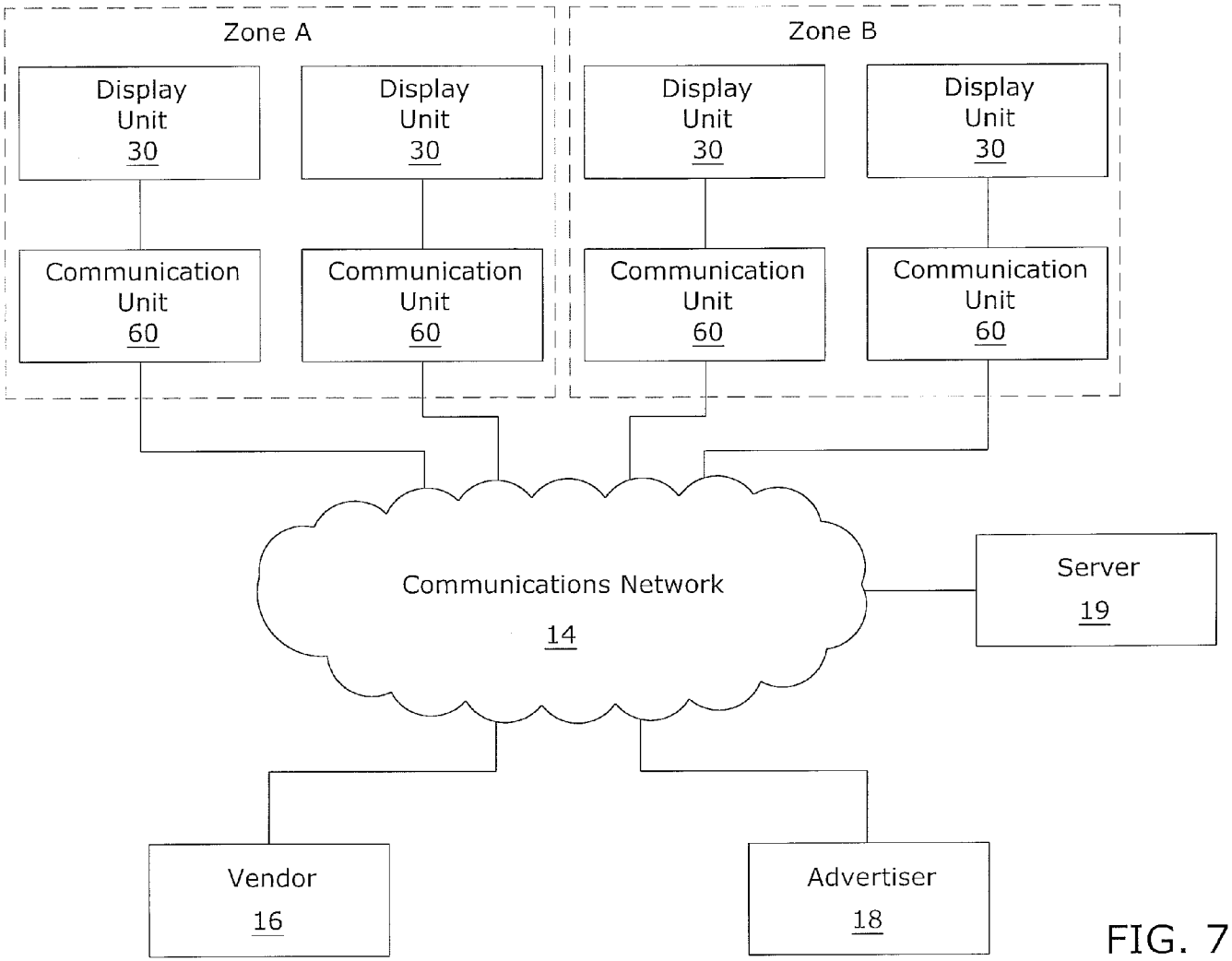
FIG. 7 is a block diagram illustrating an exemplary communications system for the present invention.

FIG. 7 illustrates a plurality of communication units 60 in communication with the display units 30 used in the vending machines 20. The communication units 60 communicate via the communications network 14 with the server 19 to receive the programming for the messages to be displayed along with instructions on how, when and frequency to display each of the messages. The communication unit 60 may be separate from the display unit 30 or integral with the display unit 30. The communication unit 60 may also utilize an existing communications systems within the vending machine 20 to allow for communications with the display unit 30 by the server 19.

The communication units 60 may be comprised of any device capable of communicating with the chosen communications network 14 (e.g. a modem, a pager receiver, wireless receiver). The communication units 60 may also communicate the status of the vending machine 20, weather information and other types of information back to the server 19 for use by the company, vendor 16 or advertiser 18. The communication units 60 also preferably are capable of monitoring when a purchase occurs at the vending machine 20 and identifying the message displayed at the time of the purchase, then forwarding data to the server 19 for storage and report generation. The server 19 is able to provide reports and related information to the vendor 16 and/or the advertiser 18 identifying the number of people that viewed the message at the vending machines 20.

F. Server

The present invention is preferably embodied within a software application installed upon the server 19 as shown in FIG. 7 of the drawings. The server 19 may be comprised of a computer or other device capable of receiving, storing and transmitting data relating to the messages to be displayed on the display units 30. The server 19 preferably includes a database where the messages and information relating to each of the display units 30 is stored. Each of the display units 30 is preferably identified either as a group or individually so that the server 19 can control the messages displayed on each of the display units 30 at any given time.

The server 19 is preferably programmable and controls the plurality of display units 30. A vendor 16 or an advertiser 18 preferably can login to their account on the server 19 via a website hosted by the server 19 (or in communication with the server 19). The vendor 16 or advertiser 18 can then adjust settings to control the messages displayed on the display units 30. For example, an advertiser 18 could select a first advertisement to be displayed in a plurality of display units 30 in Zone A (e.g. geographical location, type of vending machine 20, etc.) and a second advertisement to be displayed in a plurality of display units 30 in Zone B. Pricing and purchase information is preferably incorporated via the login webpage so that the advertiser 18 can purchase the desired advertising at anytime. The company operating the server 19 may also have a message pre-approval process wherein they are able to pre-approve all messages prior to being displayed on the display units 30.

The server 19 is in communication with the communication units 60 via the communications network 14 as shown in FIG. 7 of the drawings. The server 19 communicates the various messages to be displayed on the display unit 30 to the communication units 60 which then transfer the data to the display unit 30 for display.

G. Communications Network

FIG. 7 illustrates the usage of a communications network 14. The communications network 14 used in the present invention preferably has the ability to reach across broad geographic locations and wherever vending machines 20 may be located. Examples of preferred communications networks 14 are global computer networks (e.g. Internet), wireless pager networks, wireless networks, telephone networks and the like.

The Internet is basically comprised of a "global computer network." A plurality of computer systems around the world are in communication with one another via this global computer network and are able to transmit various types of data between one another. The communications between the computer systems may be accomplished via various methods such as but not limited to wireless, Ethernet, cable, direct connection, telephone lines, and satellite. One or more web servers 19 typically provide the data to the computer systems connected via the Internet.

The present invention may also be utilized upon local area networks (LAN), wide area networks (WAN), campus area networks (CAN), metropolitan-area networks (MAN), and home area networks (HAN). Various protocols may be utilized by the electronic devices for communications such as but not limited to HTTP, SMTP, FTP and WAP (Wireless Application Protocol). The present invention may be implemented upon various wireless networks such as but not limited to CDPD, CDMA, GSM, PDC, PHS, TDMA, FLEX, REFLEX, IDEN, TETRA, DECT, DATATAC, and MOBITEX. The present invention preferably utilizes a wireless pager network for transmitting data, however it can be appreciated that as future technologies are created that various aspects of the invention may be practiced with these improved technologies.

H. Operation of Present Invention

In use, the company operating the display units 30 first installs the display units 30 in various vending machines 20 operated by vendors 16. The communication unit 60 corresponding to each display unit 30 is setup to communicate via the communications network 14 with the server 19. The communications may be comprised of a constant real-time communication or a periodic prescheduled communication pattern. Advertisers 18 are then invited and allowed to create accounts through the server 19 via a web-based interface. The advertisers 18 are then able to purchase advertising to display messages upon the display units 30 of their choice in one or more zones. The zones may be comprised of display units 30 in various geographical locations, business location type, type of vending machine 20 and other factors.

After the advertisers 18 purchase advertising to be displayed on the display units 30, the server 19 communicates the messages to be displayed for each display unit 30 via the corresponding communication unit 60 along with any scheduling information relating to each message to be displayed. If no scheduling information is provided to the display unit 30, the display unit 30 may automatically display the received message in a preprogrammed manner. The communication unit 60 transfers the message to be displayed to the display unit 30 which then displays the message according to the schedule (or in an automatic rotating manner with other messages). For messages that exceed the length of the screen of the display unit 30, the messages may be horizontally scrolled or vertically scrolled to allow consumers to view the entire message. Graphics such as company logos may be displayed with the text of the advertisements also.

The company, the advertiser 18 and/or the vendor 16 may make various types of adjustments to the messages being displayed by the display unit 30 including but not limited to removing messages, pausing messages, modifying messages, enhancing messages, modifying the message schedule, modifying frequency of display, modifying the time of display and the like.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A vending machine messaging system, comprising:

a vending machine having a window and merchandise, wherein said vending machine dispenses said merchandise as ordered by a customer;

a display unit attached to said vending machine, wherein said display unit displays messages, wherein said display unit is attached to an interior surface of said window;

a shield attached to said interior surface of said window, wherein said shield is positioned above said display unit, wherein said shield is comprised of an upper portion extending downwardly at an angle from said window and a lower portion extending downwardly from said upper portion;

a length of sealant attached to said interior surface of said window and said upper portion of said shield; and a server in communication with said display unit via a communications network, wherein said server communicates various messages to be displayed to said display unit.

2. The vending machine messaging system of claim 1, wherein said display unit is attached to a lower portion of said interior surface of said window.

3. The vending machine messaging system of claim 2, wherein said display unit is attached adjacent to a bottom edge of said interior surface of said window.

4. The vending machine messaging system of claim 1, wherein said messages are comprised of advertisements.

5. The vending machine messaging system of claim 1, wherein said messages are comprised of nutritional information regarding said merchandise.

6. The vending machine messaging system of claim 1, wherein said display unit displays text messages and/or graphical images.

7. The vending machine messaging system of claim 1, wherein said display unit is comprised of an LED dot-matrix display.

8. The vending machine messaging system of claim 1, wherein said lower portion is attached to a rear face of said display unit by a rear securing device.

9. The vending machine messaging system of claim 1, wherein said shield defines a passage between said window and said shield, wherein a length of wiring connected to said display unit passes through said passage.

10. The vending machine messaging system of claim 1, wherein said display unit is attached to an interior surface of said window by at least one front securing device.

11. The vending machine messaging system of claim 10, wherein said at least one front securing device is comprised of adhesive.

12. The vending machine messaging system of claim 10, wherein said at least one front securing device is comprised of hook and loop fastener.

13. The vending machine messaging system of claim 1, including a communication unit in communication with said display unit, wherein said communication unit is in communication with said server via said communications network.

14. A vending machine messaging system, comprising:

a vending machine having a window and merchandise, wherein said vending machine dispenses said merchandise as ordered by a customer;

a display unit attached to an interior surface of said window of said vending machine, wherein said display unit displays messages and wherein said display unit is attached to a lower portion of said interior surface of said window;

wherein said display unit is attached to said interior surface of said window by at least one front securing device;

wherein said display unit is comprised of an LED dot-matrix display;

a shield attached to an interior surface of said window, wherein said display unit is attached to said interior surface of said window, wherein said shield is positioned above said display unit, wherein said shield is comprised of an upper portion extending downwardly at an angle from said window and a lower portion extending downwardly from said upper portion, and wherein said lower portion is attached to a rear face of said display unit by a rear securing device;

a length of sealant attached to said interior surface of said window and said upper portion of said shield;

a communication unit in communication with said display unit; and a server in communication with said communication unit via a communications network, wherein said server communicates various messages to be displayed on said display unit to said communications unit, wherein said server is programmable and controls a plurality of display units.

15. The vending machine messaging system of claim 14, wherein said shield defines a passage between said window and said shield, wherein a length of wiring connected to said display unit passes through said passage.

* * * * *